US008740192B2

(12) United States Patent
Wentworth et al.

(10) Patent No.: US 8,740,192 B2
(45) Date of Patent: Jun. 3, 2014

(54) WEDGE LOCKING UNIT FOR A RAIL ASSEMBLY

(71) Applicants: Michael Blain Wentworth, Berkeley, CA (US); Sean Dunn Wentworth, El Cerrito, CA (US)

(72) Inventors: Michael Blain Wentworth, Berkeley, CA (US); Sean Dunn Wentworth, El Cerrito, CA (US)

( * ) Notice: Subject to any disclaimer, the term of this patent is extended or adjusted under 35 U.S.C. 154(b) by 0 days.

(21) Appl. No.: 13/909,325

(22) Filed: Jun. 4, 2013

(65) Prior Publication Data

US 2013/0320282 A1 Dec. 5, 2013

Related U.S. Application Data

(60) Provisional application No. 61/655,352, filed on Jun. 4, 2012.

(51) Int. Cl.
*E04H 17/00* (2006.01)

(52) U.S. Cl.
USPC ..... 256/65.12

(58) Field of Classification Search
USPC ..... 256/65.01, 65.08, 65.11, 65.12, 68, 69, 256/70
See application file for complete search history.

(56) References Cited

U.S. PATENT DOCUMENTS

| | | | | |
|---|---|---|---|---|
| 810,232 | A * | 1/1906 | Thomas | 256/52 |
| 3,511,477 | A * | 5/1970 | Seery | 256/67 |
| 3,722,701 | A * | 3/1973 | Malcik et al. | 211/194 |
| 3,837,754 | A * | 9/1974 | Malcik | 403/217 |
| 3,921,960 | A * | 11/1975 | Bright | 256/65.12 |
| 4,235,559 | A * | 11/1980 | Rooklyn | 403/262 |
| 4,252,313 | A * | 2/1981 | Skalka | 482/36 |
| 5,354,037 | A * | 10/1994 | Venegas, Jr. | 256/59 |
| 6,679,481 | B2 * | 1/2004 | McNalley et al. | 256/65.12 |
| 7,266,932 | B2 * | 9/2007 | Rowan | 52/656.1 |
| 7,503,551 | B2 * | 3/2009 | Auret | 256/65.12 |
| 2009/0152524 | A1 * | 6/2009 | Keller | 256/65.12 |

* cited by examiner

*Primary Examiner* — Michael P Ferguson
*Assistant Examiner* — Daniel Wiley
(74) *Attorney, Agent, or Firm* — Temmerman Law Office; Mathew J. Temmerman

(57) ABSTRACT

The invention provides an easy to assemble railing assembly used for residential and commercial purposes. The railing assembly includes a plurality of locking components, a plurality of upright members and a plurality of locking pins. A locking component includes a plurality of wedge shaped locking slots. An upright member is configured to receive the locking component therewithin. The locking pin of the plurality of locking pins has each end connected to one or more wedge shaped locking slots of the plurality of wedge shaped locking slots.

4 Claims, 9 Drawing Sheets

WEDGE LOCKING UNIT FOR A RAIL ASSEMBLY

RELATED APPLICATIONS

This application is a Nonprovisional Application of and claims priority to U.S. Provisional Patent Application 61/655,352, filed Jun. 4, 2012. The provisional patent application is incorporated herein in its entirety as if set out in full.

TECHNICAL FIELD OF THE INVENTION

The present invention relates to an easy to assemble railing assembly used for residential and commercial purposes. In particular, the invention is used for fences, gates or other related ornamental metal works.

BACKGROUND OF THE INVENTION

Fencing and railings have been a necessity for many residential or commercial locations for thousands of years. As such, myriad railing systems have been developed and are still in use so as to meet both residential and commercial needs. These railing systems are traditionally mechanically fabricated using a combination of components of different standard shapes supplied by different metal suppliers and metal industries. The drawback to conventional components is that they often require a great deal of expertise, advanced skill and expensive machinery for their manufacture and installation, thereby leading to higher costs for the end customer. The metallic components of these various shapes are generally fabricated using various molding techniques and may be manually assembled using conventional welding techniques, conventional fastening techniques and so on. Further adding to the installation costs, multiple skilled workers may be required for assembling these components into a finished railing system. Moreover, the materials alone are often expensive, adding to the final cost of installation. Finally, there currently exists no easy method available for combining dissimilar metal component for making a railing system.

Hence, there is a need for an improved system for providing railing and fencing for residential and commercial purposes.

SUMMARY OF THE INVENTION

A first embodiment of the present invention includes a railing assembly used for residential and commercial purposes. The railing assembly comprises a plurality of locking components, a plurality of upright members and a plurality of locking pins. An upright member is configured to receive the locking component therewithin. The locking component includes a plurality of pairs of wedge shaped locking slots. Each locking pin of the plurality of locking pins is configured for insertion through the pair of the wedge shaped locking slots and then locked into a tightened position by mechanical force.

In another embodiment, a wedge-locking unit is disclosed. The wedge-locking unit includes a locking component having a plurality of wedge shaped locking slots. An upright member is configured to receive the locking component therewithin. Each locking pin of the plurality of locking pins is inserted through each wedge shaped locking slot, and then tightened into position by mechanical force.

In another embodiment, the method of assembling a railing is disclosed. The method includes a step of arranging a locking component within each upright member of a plurality of upright members. The locking component comprises a plurality of wedge shaped locking slots. The method further includes a step of connecting opposite end portions of a locking pin into a wedge shaped locking slot of the locking component arranged within the upright member of the plurality of upright members. The method also includes a step of engaging a fastening unit to the locking component for locking the opposite end portions of the locking pin The present invention disclosed herein is an easy to assemble, sturdy and rattle-free railing assembly capable of spanning longer horizontal distances than is allowed through conventional railing installation methods. The present invention further provides an easy means for attaching dissimilar metals to one another such as aluminum and steel. As the railing assembly disclosed does not require skilled labor or lengthy installation times, the railing assembly is more cost effective than conventional systems.

BRIEF DESCRIPTION OF DRAWINGS

The foregoing and other features of embodiments will become more apparent from the following detailed description of embodiments when read in conjunction with the accompanying drawings. Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention. Thus, in the interest of clarity and conciseness, the drawings are generalized in form, wherein.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable a person skilled in the art to practice the invention, and it is to be understood that other embodiments may be utilized and that logical, mechanical, and other changes may be made within the scope of the embodiments. The following detailed description is, therefore, not be taken as limiting the scope of the invention, but instead the invention is to be defined by the appended claims.

The present invention provides a railing assembly used for residential and commercial purposes. The railing assembly comprises a plurality of locking components, a plurality of upright members and a plurality of locking pins. Each of the plurality of locking component comprises a plurality of wedge shaped locking slots. Each of said plurality of upright members is configured receive one of the locking components therewithin. Each locking pin of the plurality of locking pins is inserted through and links two oppositely positioned wedge-shaped locking slots.

Figure 1:
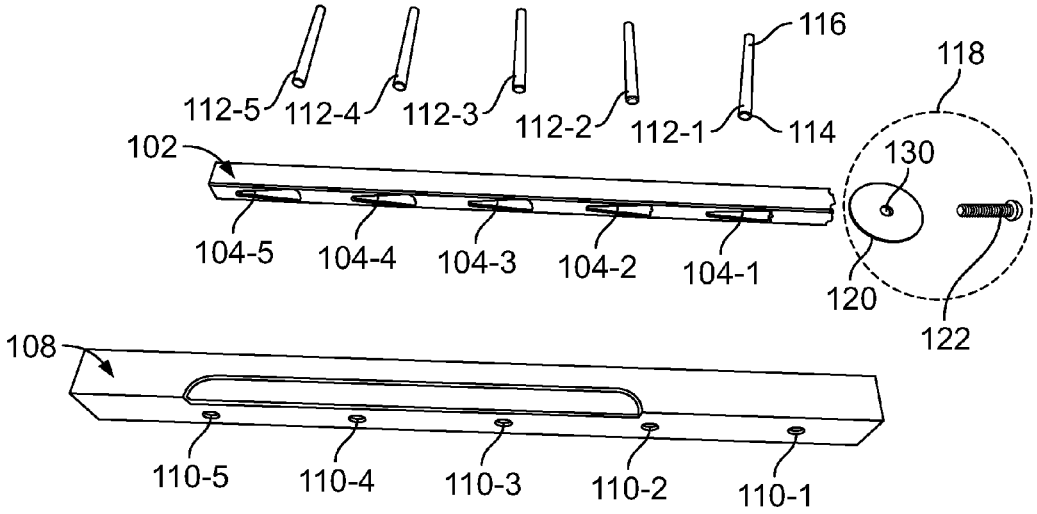
FIG. 1 illustrates an exploded perspective view of wedge locking unit in accordance with a preferred embodiment of the invention.
Figure 2:
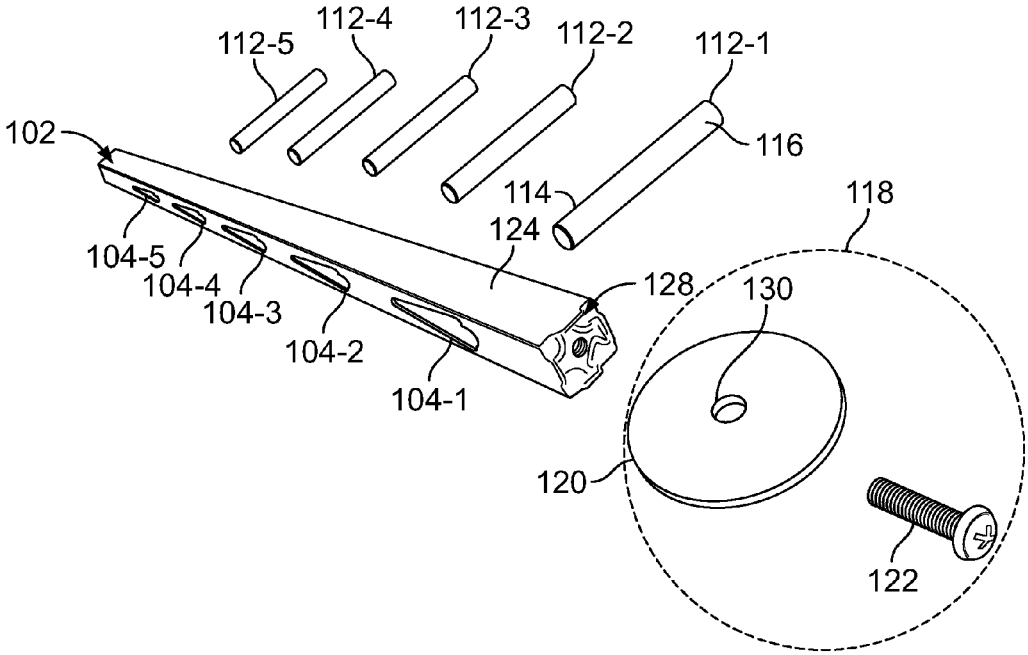
FIG. 2 illustrates an exploded perspective view of several components of the wedge locking unit in accordance with the preferred embodiment of the invention.

Turning now to FIGS. 1 and 2, an exploded perspective view of a wedge-locking unit is illustrated in accordance with a preferred embodiment of the invention. The wedge locking unit includes a locking component 102 depicted adjacent to an upright member 108 for ease of understanding, which itself is shown with a partial section cutaway for ease of understanding given that as explained below the locking component 102 is positioned inside the upright member 108. The locking component 102 includes plurality of wedge shaped locking slots such as wedge shaped locking slot 104-1, wedge shaped locking slot 104-2, wedge shaped locking slot 104-3, wedge shaped locking slot 104-4 and wedge shaped locking slot 104-5. Fewer or greater numbers of additional wedge shaped locking slots may be present, and in totality these components may be referred to as a plurality of wedge shaped locking slots. The locking component 102 is has identical structures on its left and right side, such that a mirror image line may be drawn longitudinally down the component. As such, each of the plurality of wedge shaped locking slots depicted has an equal wedge shaped locking slot (see FIG. 3) on the opposite side of the locking component 102. In the preferred embodiment, the upright member 108 is substantially hollow throughout its cross-section such that locking component 102 may be inserted therein for use. This is shown in FIGS. 4A and 4B where the two components are depicted as fully assembled. Preferably each of a plurality of holes 110 present on the upright member 108 will overlap with each of said plurality of wedge shaped locking slots 104. The locking component 102 has a cross-section that may be rectangular, square or circular.

Figure 3:
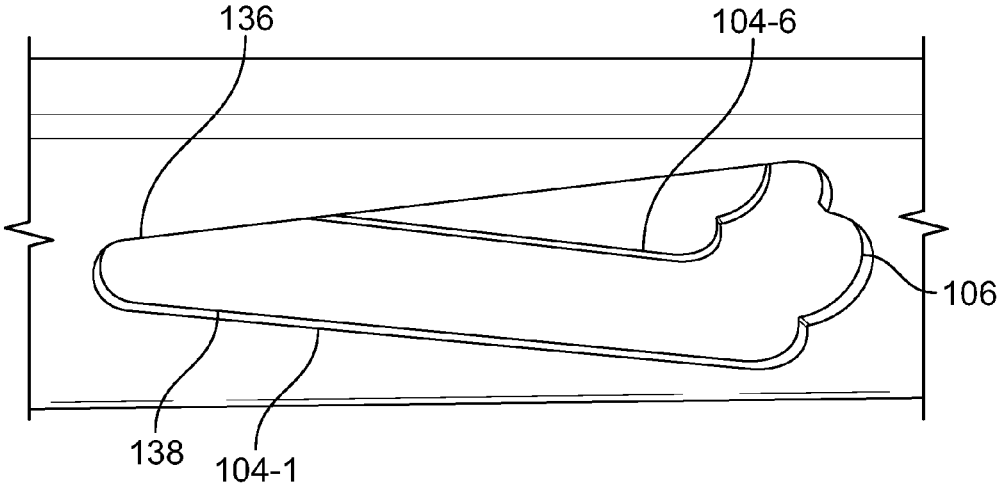
FIG. 3 illustrates a perspective view of a wedge shaped locking slot in accordance with the preferred embodiment of the invention.
Figure 4A:
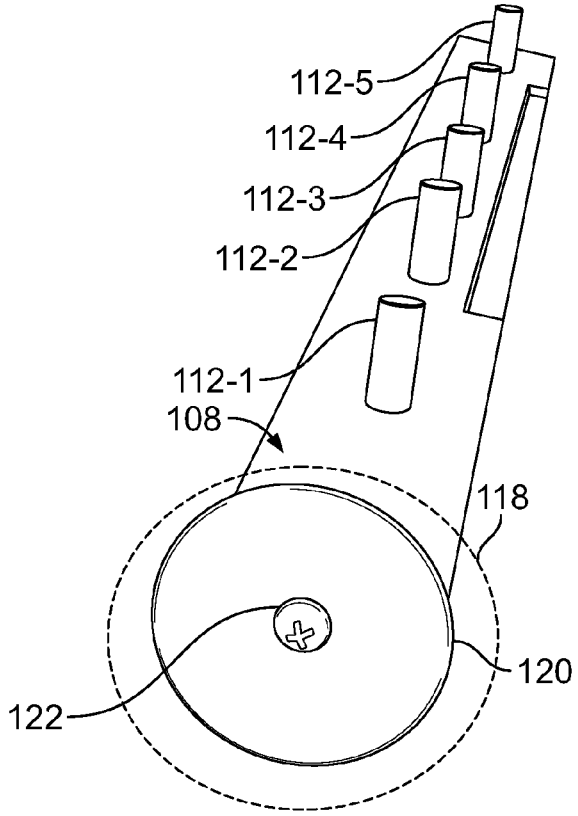
FIG. 4A illustrates a perspective view of a wedge locking unit in accordance with the preferred embodiment of the invention.
Figure 4B:
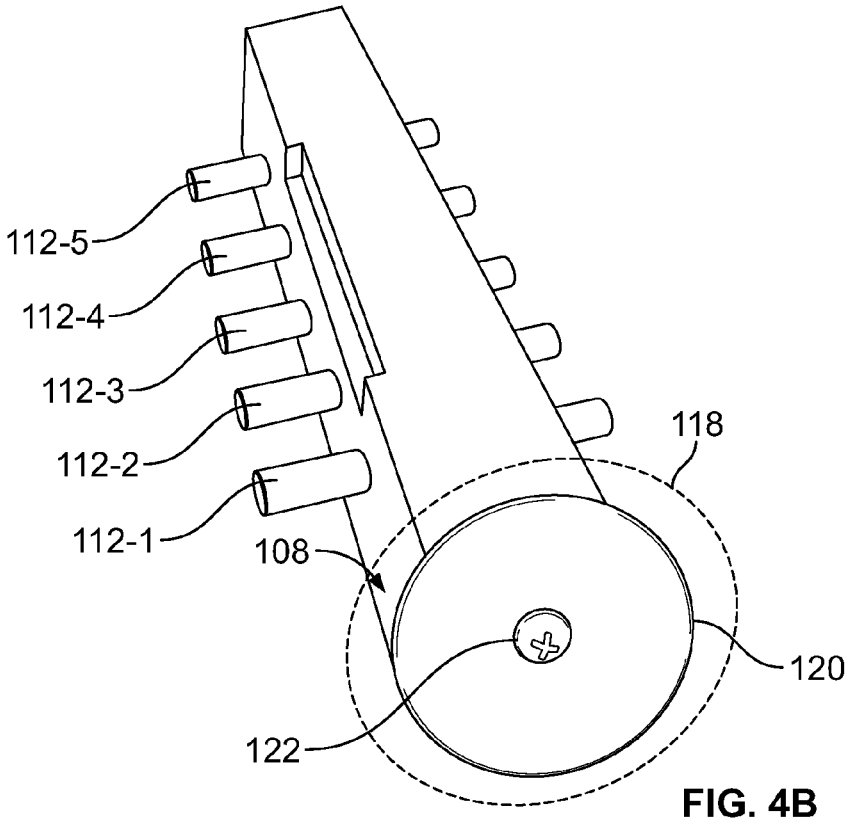
FIG. 4B illustrates a different perspective view of a wedge locking unit in accordance with the preferred embodiment of the invention.
Figure 13:
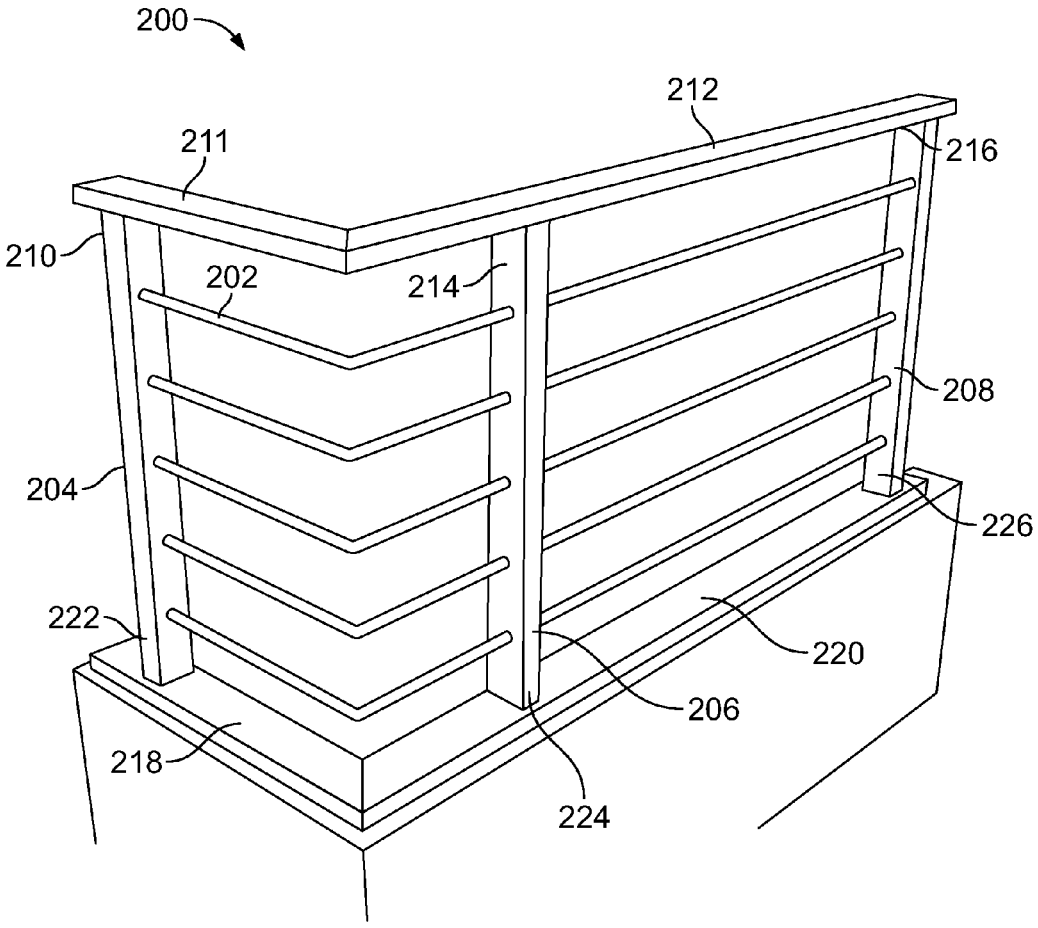
FIG. 13 is a perspective view of fully assembled railing in accordance with the preferred embodiment of the invention.

One exemplary wedge shaped locking slot is shown in FIG. 3, although the description here will apply to each of the plurality of wedge shaped locking slots. Here, the wedge shaped locking slot 104-1 is positioned opposite another wedge shaped locking slot (in this FIG. defined as 104-6) thereby forming a pair of wedge shaped locking slots and a hollow passage (not labeled) through which a locking pin (described in additional detail below) may be inserted therethrough. Once fully assembled and each of the plurality of locking pins is connected to each of the plurality of wedge shaped locking slots, a railing assembly 200 may be formed as shown in FIG. 13.

Figure 5A:
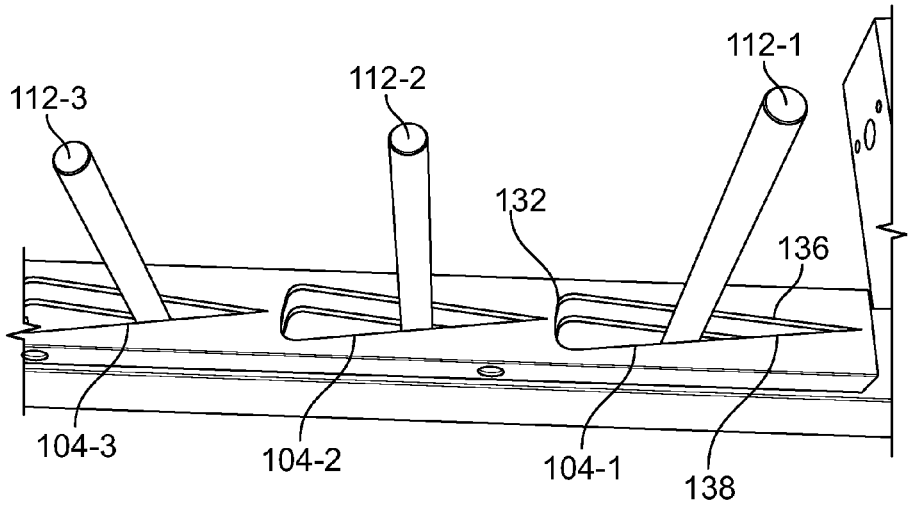
FIG. 5A illustrates a locking component having locking pins received and locked in a wedge shaped locking slot in a tightened position in accordance with the preferred embodiment of the invention.
Figure 5B:
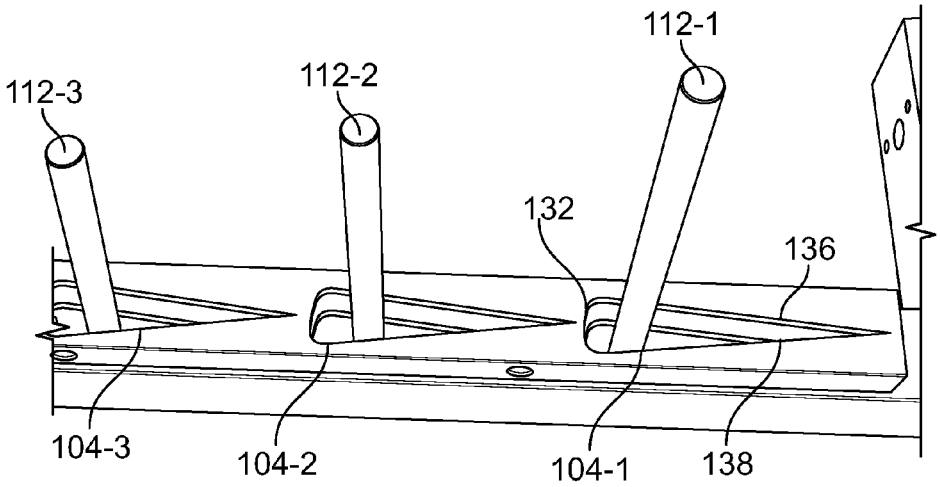
FIG. 5B illustrates a locking component having locking pins received in the wedge shaped locking slot in a loosened position in accordance with the preferred embodiment of the invention.

As briefly described above, the upright member 108 includes a plurality of holes such as hole 110-1, hole 110-2, hole 110-3, hole 110-4 and hole 110-5 as shown in FIG. 1. Fewer or greater numbers of holes may be present and in sum they may be referred to herein as a plurality of holes. Just as with the wedge shaped locking slots, there is an equal hole opposite each of the visible holes in FIG. 1, and just as locking component 102 has identical left and right sides, upright member 108 is similarly configured. The upright members and the locking components may be made or composed of metallic material such as cast iron, aluminum, steel, hard plastic, or other suitable materials for use in fencing and railing. The locking pin may have a circular cross-section. However, it may be appreciated that the locking pin may have any other suitable cross-section such as a rectangle, a square and so on. The locking pin is preferably composed or made of metallic material such as, cast iron, aluminum, steel, or other hard materials suitable for use as a locking pin subjected to shear forces. The plurality of locking pins in an exemplary case includes locking pin 112-1, locking pin 112-2, locking pin 112-3, locking pin 112-4 and locking pin 112-5 and shown in FIG. 2. Shown as an example of all locking pins, locking pin 112-1 has two ends: end 114 and end 116. Similar, but unlabeled components are present on each of the locking pins. During installation, end 114 is passed through hole 110-1, the wedge shaped locking slot 104-1, the wedge shaped locking slot 104-6 and a second unlabeled hole opposite hole 110-1. FIGS. 5A and 5B show the locking pins passing through the wedge shaped locking slots. The other end 116 of locking pin 112-1 may be connected to another locking component configured with another upright member so as to form an elongate row of bars, of which 5 are shown in FIG. 13. Similarly other locking pins may be allowed to pass through corresponding wedge shaped locking slots in the locking component 102 during assembly of the complete railing assembly 200.

Turning now to FIG. 3, in the preferred embodiment the wedge shaped locking slot 104-1 includes a recess 106 as shown. Opposite wedge shaped locking slot 104-6 is partially viewable in this figure. The upright member 108 has a hollow configuration and each locking component 102 is configured to be received within each upright member 108 such that at least one hole present on the upright member 108 lines up with at least one wedge shaped locking slot on the locking component 102. Further, the upright member 108 may have a cross-section similar to the cross-section of the locking component 102 for conveniently receiving the locking component 102 in a snug fitment. An upright member such as the upright member 108 may have a cross-section that may be rectangular, square, L-shaped, or circular. In the alternative embodiment wherein the upright member has an L-shaped configuration, multiple locking components may be received within the upright member.

The locking component 102 is connected to one or more fastening units for locking an end portion of each locking pin of the plurality of locking pins with the wedge shaped locking slot. A fastening unit 118 (see FIGS. 2, 4A, and 4B) includes a base member 120 having a base hole 130 and at least one fastening member such as fastening screw 122. The fastening screw 122 is threaded through the base member 120 and to an end 124 of the locking component 102. The locking component 102 includes a receiving member at the end of the locking component. The receiving member has a receiving aperture 128 (see FIG. 2) at end 124. The receiving aperture 128 is configured to receive the fastening screw 122 as it passes through base hole 130 on base member 120. In use, each locking pin, and by example locking pin 112-1 may be initially positioned at a wider portion 132 of the wedge shaped locking slot 104-1 as shown in FIG. 5B. In another scenario, locking pin 112-1 may be initially positioned at the recess 106 (as shown in FIG. 3) of the wedge shaped locking slot 104-1. In both cases, the locking pin to locking slot configuration can be described as loose, but will be tightened during installation as described below.

When the fastening screw 122 is tightened, the entire locking component is pulled toward its end 124. Because the locking pins are held securely in place by the upright member holes, the locking component is pulled relative to the locking pins such that the locking pins are repositioned in the narrower portion of the wedge, and tightened at a position within the wedge shaped locking slots and as shown best in FIG. 5A. Here each locking pin has been moved (relatively speaking) towards a narrower portion of the wedge shaped locking slot. Thus, the locking pin 112-1 will be positioned proximate to edge 136 and edge 138 of the wedge shaped locking slot 104-1. Said again, the locking pin 112-1, locking pin 112-2, locking pin 112-3 becomes tightly locked within their corresponding wedge shaped locking slot 104-1, wedge shaped locking slot 104-2 and wedge shaped locking slot 104-3 respectively by tightening the locking component 102 with the help of the fastening unit (not shown in FIG. 5A). Staying with FIGS. 5A and 5B, and by way of example, the locking pin 112-1 moves proximate to the edge 138 and 136 of the wedge shaped locking slot 104-1. FIG. 4A and FIG. 4B illustrate the perspective view of the complete assembly of the locking pins 112-1, 112-2, 112-3 and 112-4 with respect to the upright member 108 in the preferred embodiment.

Figure 6A:
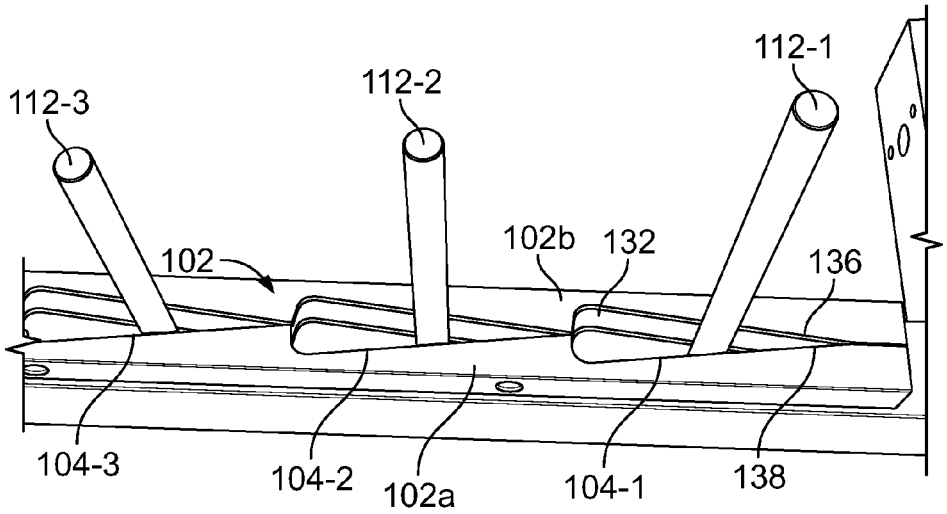
FIG. 6A illustrates a locking component having locking pins received and locked in a wedge shaped locking slot in a tightened position in accordance with an alternative embodiment of the invention.
Figure 6B:
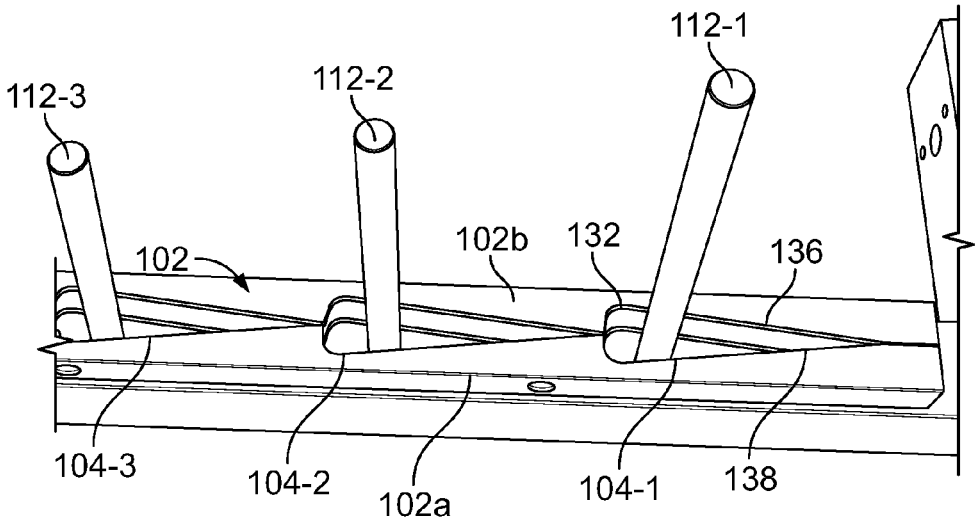
FIG. 6B illustrates a locking component having locking pins received in the wedge shaped locking slot in a loosened position in accordance with an alternative embodiment of the invention.

In an alternate embodiment, the locking component 102 may include two or more halves such as 102*a* and 102*b* joined together for forming the plurality of wedge shaped locking slots as shown in FIG. 6A. The locking pin 112-1, locking pin 112-2 and locking pin 112-3 becomes locked in their corresponding wedge shaped locking slot 104-1, wedge shaped locking slot 104-2 and wedge shaped locking slot 104-3, respectively, through a relative movement of the locking component 102 to the upright member 108 with the help of the fastening unit (not shown in FIG. 6A). The fastening unit used here may be similar to that of the fastening unit 118 as shown in FIGS. 1 and 2. Once the locking pins are locked with the wedge shaped locking slots, the locking pins move proximate to the two edges that are towards the narrower edge of the wedge shaped locking slot. For example, the locking pin 112-1 moves proximate to the edge 138 and 136 of the wedge shaped locking slot 104-1 as shown in FIG. 6A. FIG. 6B illustrates the locking component having locking pins received in the wedge shaped locking slot in loosened position. It may be appreciated that the two or more halves of the locking component may be joined together using any suitable locking technique known in the art.

Figure 7:
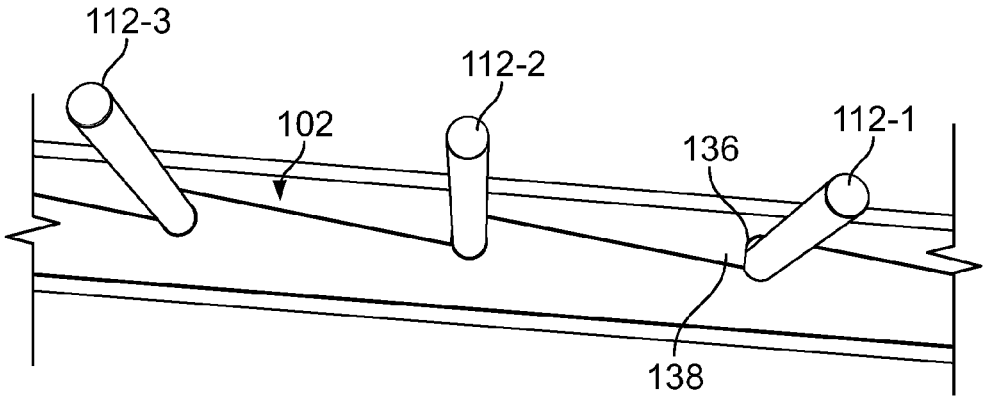
FIG. 7 illustrates a locking component having locking pins received and locked in a wedge shaped locking slot in a tightened position in accordance with an alternative embodiment of the invention.
Figure 8:
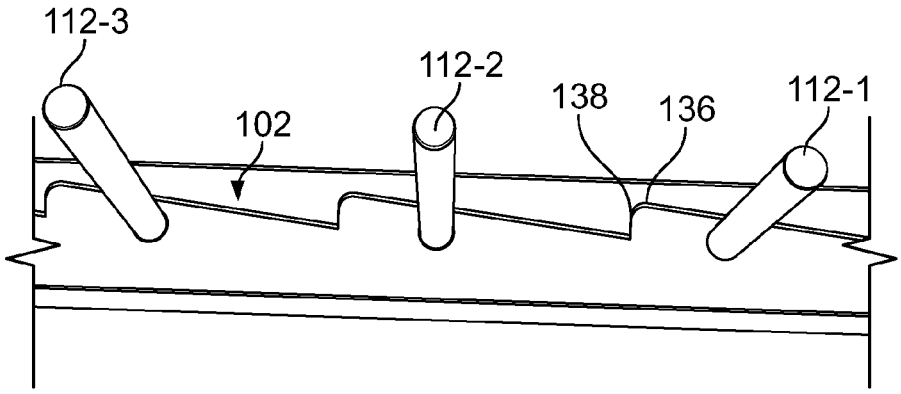
FIG. 8 illustrates a locking component having locking pins received in the wedge shaped locking slot in a loosened position in accordance with the alternative embodiment of the invention.

FIG. 7 illustrates a locking component having locking pins received and locked in the wedge shaped locking slot in a tightened position in accordance with an alternative embodiment of the invention. The locking component 102 has a partial wedge shaped locking slot. In the tightened position the locking pin 112-1 is proximate to the edges 136 and 138 there by locking the locking pins in the wedge shaped locking slot. FIG. 8 illustrates the locking component having locking pins received in the wedge shaped locking slot in a loosened position in accordance with the alternative embodiment of the invention.

Figure 9:
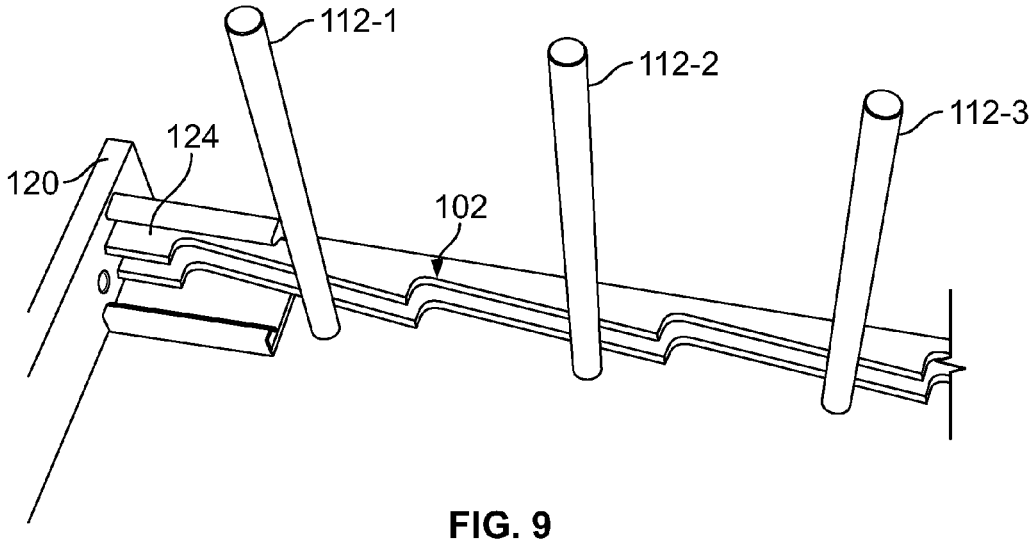
FIG. 9 illustrates a broken perspective view of the wedge locking unit along with an upright in a loosened position in accordance with the alternative embodiment of the invention.
Figure 10:
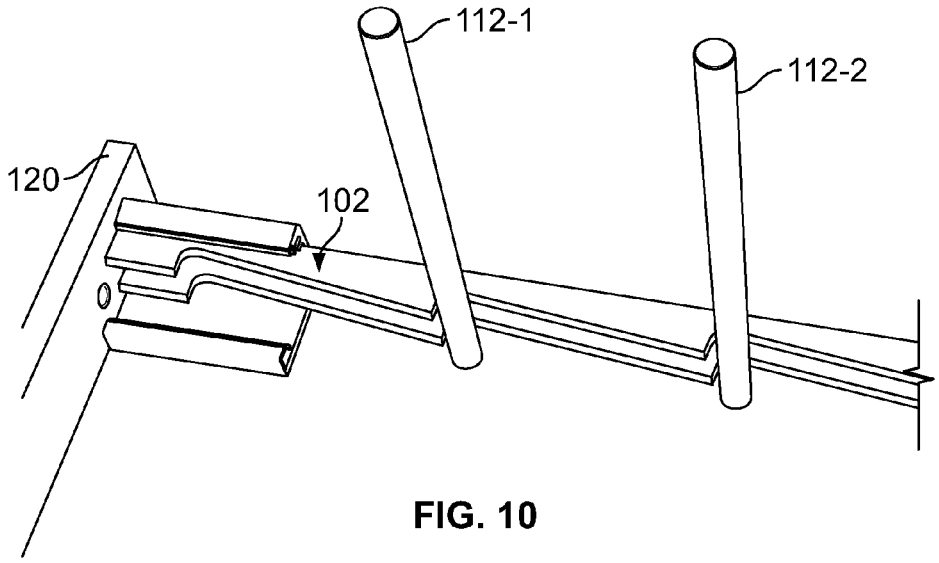
FIG. 10 illustrates a broken perspective view of the wedge locking unit along with the upright in a tightened position in accordance with the alternative embodiment of the invention.

FIG. 9 illustrates a broken perspective view of the wedge-locking unit along with an upright in a loosened position in accordance with the alternative embodiment of the invention. The locking component 102 is connected to the base member 120 by the end 124 of the locking component. Here the locking pins 112-1, 112-2 and 112-3 are held in a loosened position with respect to the locking component 102. FIG. 10 illustrates a broken perspective view of the wedge-locking unit along with the upright in a tightened position in accordance with the alternative embodiment of the invention. The locking component 102 is connected to the base member 120 by the end 124 of the locking component 102. Here the locking pins 112-1, 112-2 and 112-3 are held in a tightened position with respect to the locking component 102.

Figure 11:
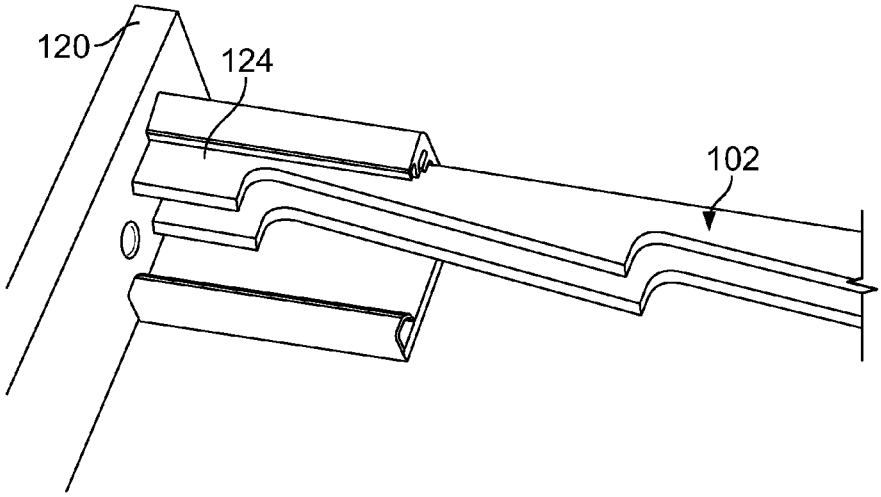
FIG. 11 illustrates a first close up broken perspective view of how the locking component mounts along with base member in accordance with one embodiment of the invention.
Figure 12:
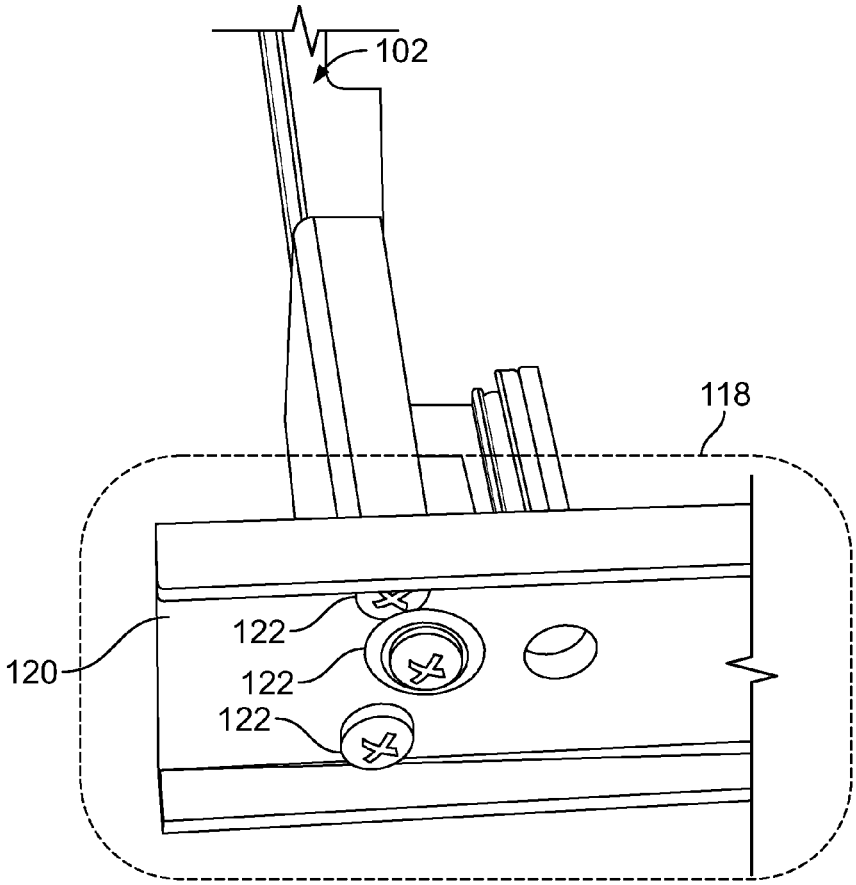
FIG. 12 illustrates a second close up broken perspective view of how the locking component mounts along with base member in accordance with one embodiment of the invention.

FIG. 11 and FIG. 12 illustrate a close up broken perspective view of how the locking component 102 mounts along with a base member 120 in accordance with an alternative embodiment of the invention. Here, the locking pin 112-1 is connected to the upright member 108 (see FIG. 13) in a fixed manner and conventional techniques such as welding and other fastening techniques need not be used while manufacturing the rail assembly 200. Further the rail assembly 200 may be easily disassembled by removing the fastening unit such as the fastening unit 118.

The rail assembly 200 as shown in FIG. 13 includes multiple upright members and multiple locking pins. The end result is an easy to assemble railing system. The locking pin 202 is long enough to span between two upright members so as to form functional rails. Spacing between the rails is a matter of design and functional choice. The locking pin 202 may have an L-shaped configuration and may be configured for connection at their ends to first upright member 204 and a second upright member 208. Further, a third upright member 206 may connect with a portion of the locking pin 202 as shown in FIG. 13. The first upright member 204, the second upright member 208 and the third upright member 206 may include a locking component for connecting to the ends and the portion of the locking pin 202. The series of upright members may be repeated to create a railing of any length. Additionally, and as shown in FIG. 13, multiple supporting members may be connected to the ends of the upright members. For instance a supporting member 211 may be connected to an end 210 of the upright member 204. Further a supporting member 212 may be connected to an end 214 of the upright member 206 and an end 216 of the upright member 208. In the same manner, one or more supporting members (such as supporting members 218 and supporting member 220) may be connected to an end 222 of the upright member 204, an end 224 of the upright member 206 and an end 226 of the upright member 208. These supporting members 211, 212, 218 and 220 may be connected to the upright members 204, 206 and 208 using any suitable fastening technique. For example, the supporting member 218 may be connected to the end 222 of the upright member 204 using fasteners such as screws 122 as shown in FIG. 12. However it may be appreciated that other techniques known in the art may be used for fastening the supporting members 211, 212, 218 and 220 to the upright members 204, 206 and 208. The railing assembly 200 thusly formed may be fixed to the ground for forming a fence for locations such as residential property. It may also be installed at the edge of a raised surface, forming a protective railing.

Different locking pins may be connected to the upright members 204, 206 and 208. For instance the locking pin 202 may connect with the upright members 204, 206 and 208. Whereas locking pin 202 may have its ends connected to the upright member 208 and the upright member 204. It is also envisaged to have the locking pin 202 consisting of two parts, one part has two ends connected to the upright members 204 and 206, and another part has two ends connected to the upright members 206 and 208. In such scenario the upright member 206 may have two locking components inside. Similarly multiple locking pins may be connected with the upright members 204, 206 and 208 for forming the rail assembly 200.

The present invention disclosed herein is an easy to assemble railing assembly which may span for longer distances horizontally between upright posts. Because metal to metal welding is not necessarily, the present invention presents and easy means for attaching dissimilar metals to one another such as aluminum and steel. As the railing assembly disclosed does not require skilled labor and lengthy installation times, the railing assembly is more cost effective.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto. It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

We claim:

1. A railing assembly comprising:

a plurality of locking components, wherein said locking component comprises a plurality of wedge shaped locking slots, each wedge shaped locking slot having a narrow end and a wide end opposite the narrow end, each locking component further comprising a receiving member with a receiving aperture at one or more ends;

a plurality of hollow upright members, wherein each upright member includes a plurality of holes, which are configured to align with the corresponding plurality of wedge shaped locking slots, when the locking component is placed within the upright member;

a plurality of rail elements, wherein each of said rail elements has at least one end portion passing through the wide end of at least one wedge shaped locking slot and a corresponding one of the holes in the upright member; and at least one fastening unit arranged at an end of each of the plurality of upright members, wherein said fastening unit comprises:

a base member; and at least one threaded fastener passing through said base member and engaging with said receiving aperture of a respective one of said plurality of locking components;

wherein rotation of the threaded fastener causes the locking component to move within the upright member such that the narrow end of the wedge shaped locking slots engages with each of the plurality of rail elements.

2. The railing assembly as claimed in claim 1, wherein the upright members and locking pins rail elements are composed of dissimilar materials.

3. A method of assembling a railing system, wherein the method comprises the steps of:

providing at least one hollow, upright member, each upright member including a plurality of holes;

providing at least one locking component having a plurality of wedge shaped locking slots, each wedge shaped locking slot having a narrow end and a wide end opposite the narrow end;

arranging the at least one locking component within each upright member;

aligning the locking component with the upright member such that the wide end of each of the wedge shaped locking slots is aligned with one of the plurality of holes in the upright member inserting an end portion of a rail element through an aligned pair of one of the holes in the upright member and one of said wedge shaped locking slots of said locking component arranged within said upright member;

providing at least one fastening unit at an end of the at least one upright member, wherein said fastening unit comprises: a base member; and at least one threaded fastener passing through said base member and engaging with said receiving aperture of a respective one of said plurality of locking components; and rotating the threaded fastener, thereby moving the locking component within the upright member such that the narrow end of the wedge shaped locking slots engages with the rail element.

4. The method as claimed in claim 3, wherein the upright members and rail elements are composed of dissimilar materials.

* * * * *